US007036962B2

(12) United States Patent
Chan

(10) Patent No.: US 7,036,962 B2
(45) Date of Patent: May 2, 2006

(54) LIGHT-UP ACCESSORY

(76) Inventor: Kwok Hung Chan, Blk. B, 12/F, Tower 4, Park Belvedere, Ma On Shan, N.T., Hong Kong (HK)

( * ) Notice: Subject to any disclaimer, the term of this patent is extended or adjusted under 35 U.S.C. 154(b) by 15 days.

(21) Appl. No.: 10/821,374

(22) Filed: Apr. 9, 2004

(65) Prior Publication Data

US 2004/0201997 A1 Oct. 14, 2004

Related U.S. Application Data

(60) Provisional application No. 60/462,123, filed on Apr. 9, 2003.

(51) Int. Cl.
*F21V 21/00* (2006.01)

(52) U.S. Cl. ..... 362/407; 362/806; 362/104; 362/103; 362/227; 362/249; 362/252; 362/646

(58) Field of Classification Search ..... 362/104, 362/103, 800, 227, 249, 252, 646, 647, 653, 362/654, 238
See application file for complete search history.

(56) References Cited

U.S. PATENT DOCUMENTS 5,924,785 A * 7/1999 Zhang et al. ..... 362/241
6,296,364 B1 * 10/2001 Day et al. ..... 362/104
6,394,626 B1 * 5/2002 McColloch ..... 363/251
6,528,954 B1 * 3/2003 Lys et al. ..... 315/291
6,578,981 B1 * 6/2003 Jackson et al. ..... 362/104
6,648,492 B1 * 11/2003 Shih ..... 362/397
2003/0112627 A1 * 6/2003 Deese ..... 362/249
2003/0223235 A1 * 12/2003 Mohacsi et al. ..... 362/240
2005/0185400 A1 * 8/2005 Hsu ..... 362/238

* cited by examiner

*Primary Examiner*—Sandra O'Shea
*Assistant Examiner*—Anabel Ton
(74) *Attorney, Agent, or Firm*—Raymond Y. Chan; David S. Raymond

(57) ABSTRACT

A light-up accessory which includes a plurality of elementary building units and a chaining arrangement, wherein each of the elementary building units includes a supporting case; a lighting system, which is disposed in the supporting case, and includes an illuminating unit; an operating system which includes an operating member electrically connected with the lighting system and operatively connected with an electrical power supply in such a manner that when the operating member is switched on, the illuminating unit is supplied with electrical power to illuminate. The chaining arrangement which contains a plurality of chaining passageways longitudinally formed on the supporting cases of the elementary building units respectively, and includes a connecting chain adapted to connect the elementary building units by passing through the chaining passageway of each of the elementary building units.

16 Claims, 7 Drawing Sheets

LIGHT-UP ACCESSORY

CROSS REFERENCE RELATED TO THE APPLICATION

This is a regular application of a provisional application having an application No. 60/462,123 and filing date of Apr. 9, 2003.

BACKGROUND OF THE PRESENT INVENTION

1. Field of Invention

The present invention relates to a kind of personal accessory, and more particularly to a light-up building element, such as a light-up bead, wherein a plurality of such light-up building elements are adapted to be connected together to form an illuminating accessory.

2. Description of Related Arts

Conventionally, there are several things which comprise a plurality of raw building elements connected or chained together to form a structure having practical utilization purpose.

Some girls' personal accessories, such as necklace, bracelet, and mobile phone belts are some of the examples. They usually comprise a plurality of building beads connected together by a thread or string to form an elongated endless structure. Girls usually wear such accessories for fun or for some practical uses such as attaching a mobile phone to her body.

On the other hand, toys involving building up a plurality of building blocks to form a designated structure, such as LEGO, has been widely accepted and welcomed by children as well as parents. From the point of view of most parents, such kind of toy helps to promote their children' creativity, logical thinking and intellectual power. From the point of view of the children, on the other hand, a suitable set of building blocks could materialize their imagination and dreams by successfully building up what they want to build.

Not withstanding their respective popularity, there are some problems regarding the above conventional accessories or toys. In regard to the above-mentioned kind of toys, their popularity is sometimes gender-sensitive, having overwhelming popularity among boys but not girls. As a matter of fact, children, because of their gender and subject to family influence, usually have differing preference towards toys. For example, boys tend to prefer robot, whereas girls prefer dolls. Generally speaking, toys' manufacturers won't discriminate children of either sex, but the reality is that children of differing sex do prefer toys of differing categories. Looking back at conventional toys involving building blocks, albeit it cannot be said that all girls do not prefer, say, robot, space shuttle or castle fortified with worriers and knights, such toys are predominately targeted to boys. In the marketplace, one can hardly discover that a doll as a toy made up with a plurality of building blocks.

Moreover, toys made up of a plurality of building blocks are usually incapable of having practical utilization. Toys are usually simply toys and no more. Nor they are designed to be portable. In fact, even if a child decides to carry it with him/her when going out, as the toy is made up of a plurality of building blocks, the child risks dropping and losing some of them. Thus, by their very nature, conventional toys made up with building blocks are unsuitable for 'outings'.

In regards to girls' accessories, no matter how beautiful they might be, when there is no light, such as in a dark environment, they lose what may be their primary function of decoration. As a matter of fact, during some festivals or celebrating events, people, irrespective of gender, may wear some kinds of decorating rings having fluorescent materials incorporated therein for fun or for show off purposes. However, for most cases, their illuminating functions cannot last long, in that the fluorescent materials incorporated into the decorating rings will die out for a predetermined period of time. As result, such decorating rings are usually not designed for long-lasting decoration purpose as in the case of, say, a necklace. Given the demand for wearing some illuminating accessories in some occasions, and the fact that conventional girl's accessories, especially those typical accessories which are made up by a plurality of raw building blocks, do not enjoy such feature or function, there is room for further development in the related field.

SUMMARY OF THE PRESENT INVENTION

A main object of the present invention is to provide an elementary building unit comprising an illuminating system for providing illumination, wherein a plurality of the building elements are capable of being chained or connected together to form a light-up accessory, such as a girl's personal accessory.

Another object of the present invention is to provide a light-up accessory comprising a plurality of elementary building units which are adapted for being connected or chained together to form a customary endless structure of the light-up accessory, so that young girls can be able to build up the light accessory by their own desires, thus providing an opportunity for them to exercise such important attributes as creativity, intelligence, handcrafting skill and the likes.

Another object of the present invention is to provide a light-up accessory which can be easily and conveniently portable, and is capable of illuminating for a long period of time according to the desire of the user of the present. In other words, users no longer necessary to replace the light-up accessory after use, as in the case of fluorescent decorating ring.

Another object of the present invention is to provide a light-up accessory which is safe and easy to operate so that it is made optimal for young girls.

Another object of the present invention is to provide a light-up accessory which is simple in structure and does not involve complicated and expensive mechanical and electrical structure so as to minimize the manufacturing and related cost of the present invention.

Accordingly, in order to accomplish the above objects, the present invention provides a light-up accessory, comprising:

a plurality of elementary building units, wherein each of said elementary building units comprises:

a supporting case having an outer light-transmissible surface formed thereon;

a lighting system which is disposed in said supporting case, and comprises an illuminating unit, and a printed circuit board electrically connected with said illuminating unit for controlling said illuminating unit to illuminate; and an operating system which comprises a operating member electrically connected with said printed circuit board and operatively connected with an electrical power supply in such a manner that when said operating member is switched on, said illuminating unit is supplied with electrical power to illuminate; and a chaining arrangement which contains a plurality of chaining passageways longitudinally formed on said supporting cases of said elementary building units respectively, and comprises a connecting chain adapted to connect said elementary building units by passing through said chaining passageway of each of said elementary building units.

These and other objectives, features, and advantages of the present invention will become apparent from the following detailed description, the accompanying drawings, and the appended claims.

DETAILED DESCRIPTION OF THE PREFERRED EMBODIMENT

Figure 1:
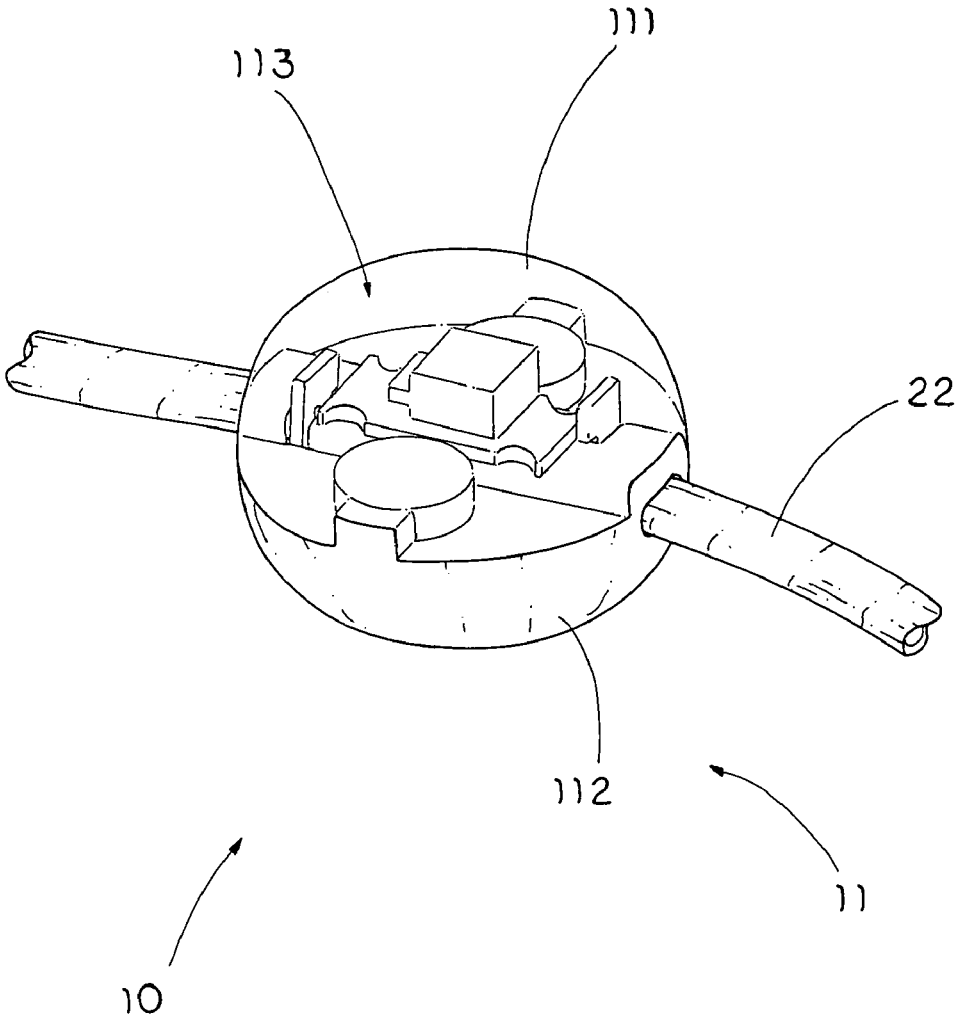
FIG. 1 is a perspective view of an elementary building unit of a light-up accessory according to a preferred embodiment of the present invention.

Referring to FIG. 1 of the drawings, an elementary building unit 10 of a light-up accessory 1 according to a preferred embodiment of the present invention is illustrated. Thus, according to the preferred embodiment, the light-up accessory 1 comprises a plurality of elementary building units 10, and a chaining arrangement 20 for chaining up the elementary building units 10 to form an endless structure, such as a girl's necklace, bracelet, and the likes.

Figure 2:
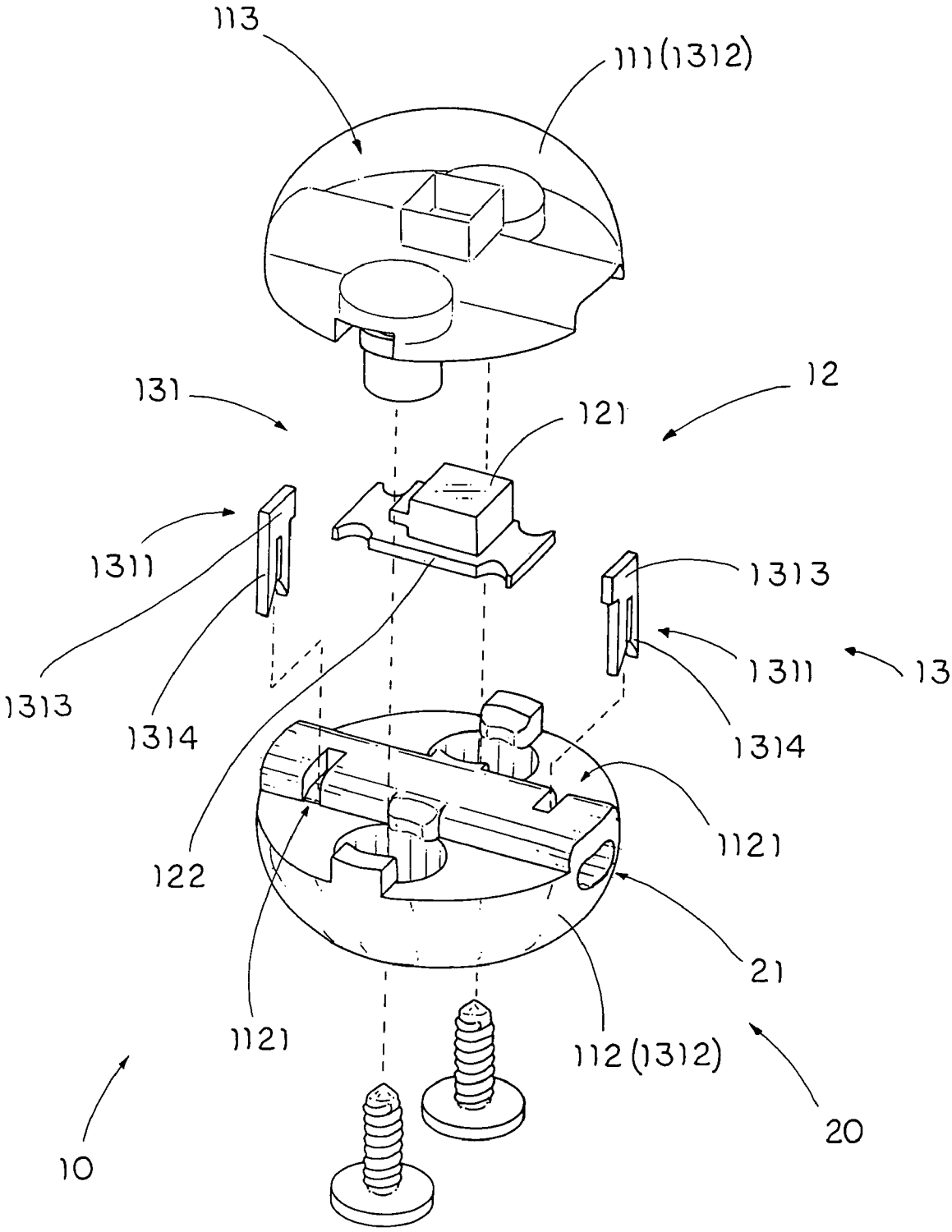
FIG. 2 is an exploded perspective view of an elementary building unit of a light-up accessory according to the above preferred embodiment of the present invention.

Referring to FIGS. 1 to 2 of the drawings, each of the elementary building units 10 comprises a supporting case 11, a lighting system 12, and an operating system 13. The supporting case 11 comprises an upper housing 111 and a lower base 112 wherein the lighting system 12 and the operating system 13 are disposed on the upper housing 111. Moreover, the upper housing 111 has a light-transmissible surface 113 formed thereon wherein light generating from the lighting system 12 is capable of reaching outside of the elementary building units 10 though the light-transmissible surface 113. According to the preferred embodiment, the light-transmissible surface 113 is achieved by utilizing plastic material having a predetermined transmissibility of light. Moreover, the upper housing 111 and the lower base 112 are adapted to be clamped together by regular screws to form the supporting case 11.

The lighting system 12 comprises at least an illuminating unit 121 disposed in the upper housing 111 for providing illumination, and a Printed Circuit Board (PCB) 122 electrically connected with the illuminating unit 121 for controlling illumination parameters, such as frequency and brightness, thereof. According to this preferred embodiment, the illuminating unit 121 is embodied as a Light Emitting Diode (LED) having predetermined illuminating features, such as the range of colors available.

Each of the elementary building units 10 is adapted to be chained with two other elementary building units 10 so as to form a series for practical utilizations. Thus the chaining arrangement 20 contains a plurality of chaining passageways 21 longitudinally formed on each of the lower base 112 respectively wherein two ends of each of the chaining passageways 21 define two openings on the respective supporting case 10. In other words, each of the upper housing 111 is capable of communicating with the respective chaining passageway 21. The chaining arrangement 20 further comprises a connecting chain 22 adapted to pass through the elementary building units 10 via the chaining passageways 21 so as to chain up all the elementary building units 10. The connecting chain 22 can simply be embodied as a thread or a string having a predetermined and sufficient strength for holding all the elementary building units 10. However, according to the preferred embodiment, the connecting chain 22 is embodied as a two-wire cable comprising two insulating wire protective layers and two regular electrical wires embedded therein respectively.

Figure 3:
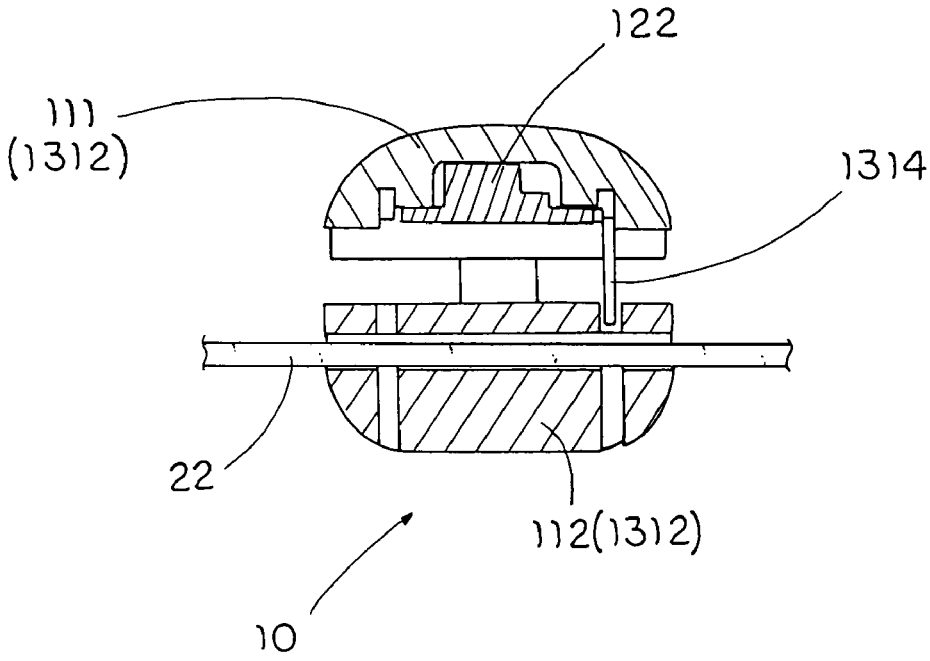
FIG. 3 is a schematic diagram of an elementary building unit of a light-up accessory according to the above preferred embodiment of the present invention, illustrating that the lighting switch is in the idle position.
Figure 4:
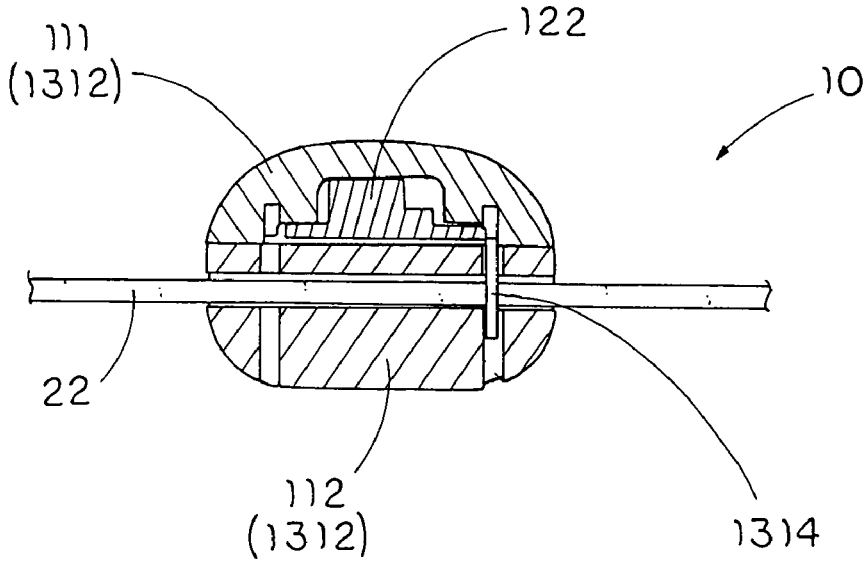
FIG. 4 is a schematic diagram of an elementary building unit of a light-up accessory according to the above preferred embodiment of the present invention, illustrating that the lighting switch is in the operative position.

Referring to FIG. 3 to 4 of the drawings, the operating system 13 comprises an operating member 131 electrically connected with the PCB 122 and operatively connected with an external power source so as to provide electricity to the PCB 122 for powering up the illuminating unit 10. The operating member 131 is embodied as comprising a pair of conducting members 1311 and a lighting switch 1312, wherein the lighting switch 1312 is arranged to drive the conducting members 1311 to connect with an electrical source upon switching on by a user of the present invention.

The conducting member 1311 comprises two wire cutters 1313 provided on two side portions of the upper housing 111 respectively, wherein each of the wire cutters 1313 comprises two elongated cutting members 1314 having an inwardly inclined cutter blade downwardly and spacedly extended towards two end portions of the chaining passageway 21 so as to define a receiving gap between the two cutting members 1314. In addition, the lower base 112 further has two cutting slots 1121 formed thereon communicating the respective chaining passageway 21 and the upper housing 111 wherein the two wire cutters 1313 are arranged to be substantially aligned with the two cutting slots 1121 respectively.

The lighting switch 1312 of the operating member 131 is embodied as the upper housing 111 and the lower base 112 wherein by clamping the upper housing 111 and the lower base 112 towards each other, the conducting members 1311 is driven to move towards the corresponding chaining passageway 21 through the two cutting slots 1121 in such a manner that the cutter blade is adapted to cut and shear the insulating wire protective layer so that the electrical wires embedded therein are adapted to be tightly held in the respective receiving gap to make a direct contact with the conducting member 1311. Thus, when the connecting chain 21 is applied with a potential difference by an external electricity source, the PCB will be supplied with electrical power to control the illumination of the illuminating units 121.

In other words, the lighting switch 1312 is adapted to move between an operative position and an idle position, wherein in the operative position, the upper housing 111 and the lower base 112 are clamped together in such a manner that the conducting members 1311 is driven to move towards the corresponding chaining passageway 21 through the two cutting slots 1121 to cut and shear part the insulating wire protective layer so that the electrical wires embedded therein are adapted to be tightly held in the respective receiving gap to make a direct contact with the conducting member 1311, wherein in the idle position, the upper hosing 111 and the lower base 112 is moved away from each other and the user of the present invention is able to pull out or replace the connecting chain 21 for further connecting or reducing the number of elementary building units 10 utilized in the light-up accessory 1.

Accordingly, the diameter of each of the electrical wires should be substantially as same as or slight smaller than a width of the respective receiving gap so that it can be tightly received therein.

The light-up accessory 1 of the present invention can further comprises a Direct Circuit (DC) battery hub 30 have two electrical terminals which hare adapted to connect with the two electrical terminals of the two-wire cable (connecting chain 21).

The operation of the light-up accessory 1 of the present invention is demonstrated as follows: at the very beginning, a user of the present invention, such as a young girl, can deicide what she wants to assemble. For example, she may want to build up a necklace. Then she needs to decide how many elementary building units 10 are required. After that, she should be able to connect the required elementary building units 10 by inserting the connecting chain 22 into the chaining passageways 21 on the relevant elementary building units 10 and clamp the respective upper housing 111 and lower base 112 together in the operative position. Finally, the two terminals of the connecting chain 22 should be connected to the two terminals of the battery hub 30 to form an endless light-up accessory 1. At the same time, the battery hub 30 will power up all the illuminating units 10 so that the light-up accessory of the present invention eventually become an 'illuminating necklace'.

Conversely, when the girl wants to expand or curtail the number of elementary building units 10, she may simply unclamp the upper housing 111 and the lower base 112 of each of the elementary building units 10 and then pull out or replace the connecting chain 22 with another one of appropriate length.

Thus, one can appreciate that the above-mentioned process can essentially be achieved solely by the hands of a young girl without risking to have any potential harm inflicted to her. The young girl can be able to select what he likes to build for a particular circumstance and utilize it not only as merely a toy, but also as an accessory of practical purposes. Note that, moreover, the shape of the elementary building units 10 can be varied for suiting various purposes. Thus, a set of elementary building units 10 can be supplied to users of the present invention so as to provide optimal satisfaction to her.

It is worth mentioning that the supporting case 11 can be embodied as a variety of building elements of a variety of accessories, such as a bead for girl's necklace or bracelet, so as to fulfill differing requirements of the users of the present invention.

Figure 6:
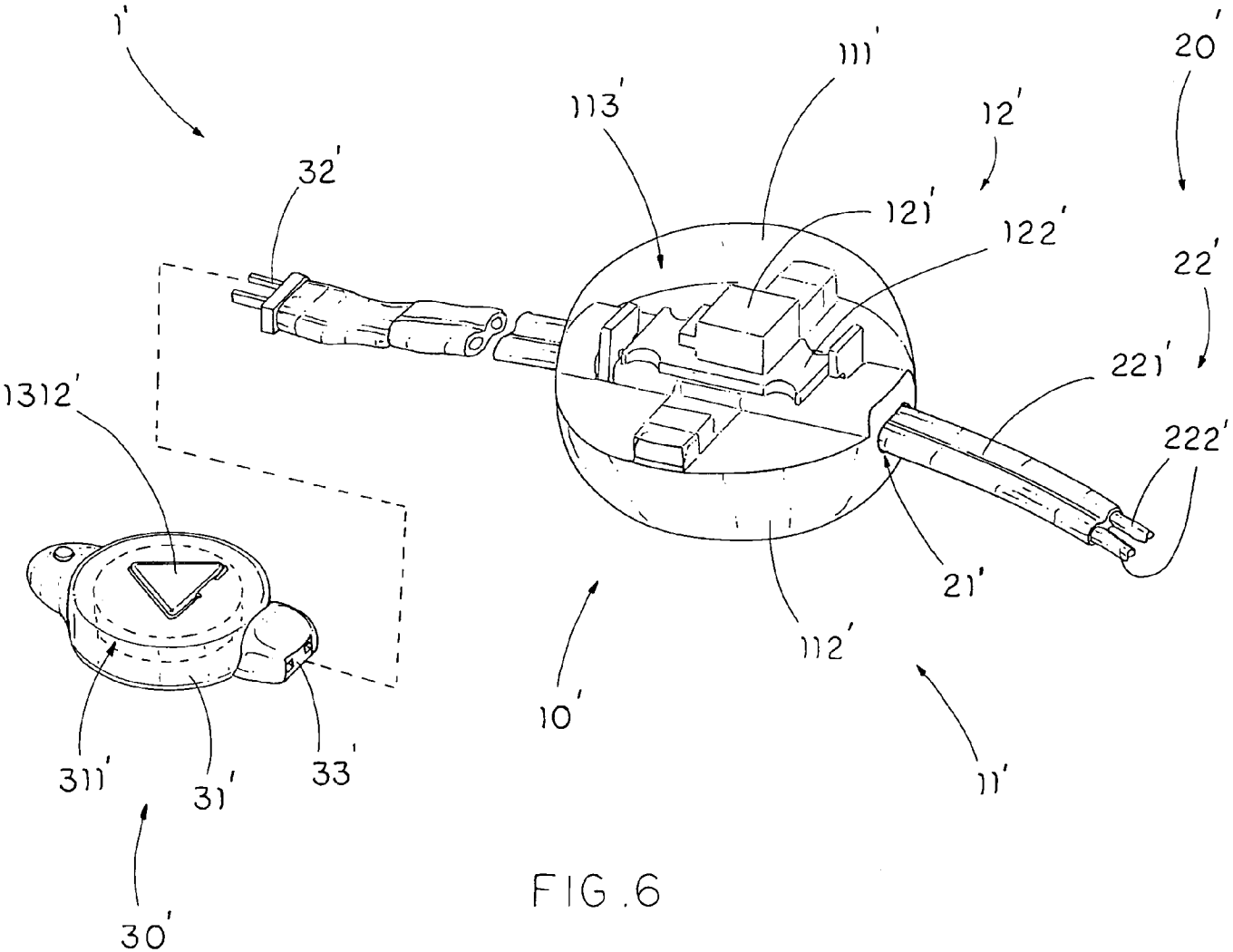
FIG. 6 is a perspective view of an elementary building unit of a light-up accessory according to a second preferred embodiment of the present invention.

As shown in FIG. 6, a light-up accessory 1' according to a second embodiment illustrates an alternative mode of the first embodiment of the present invention, wherein the light-up accessory 1' comprises a plurality of elementary building units 10', and a chaining arrangement 20' for chaining up the elementary building units 10 to form an endless structure, such as a girl's necklace, bracelet, and the likes.

Figure 7:
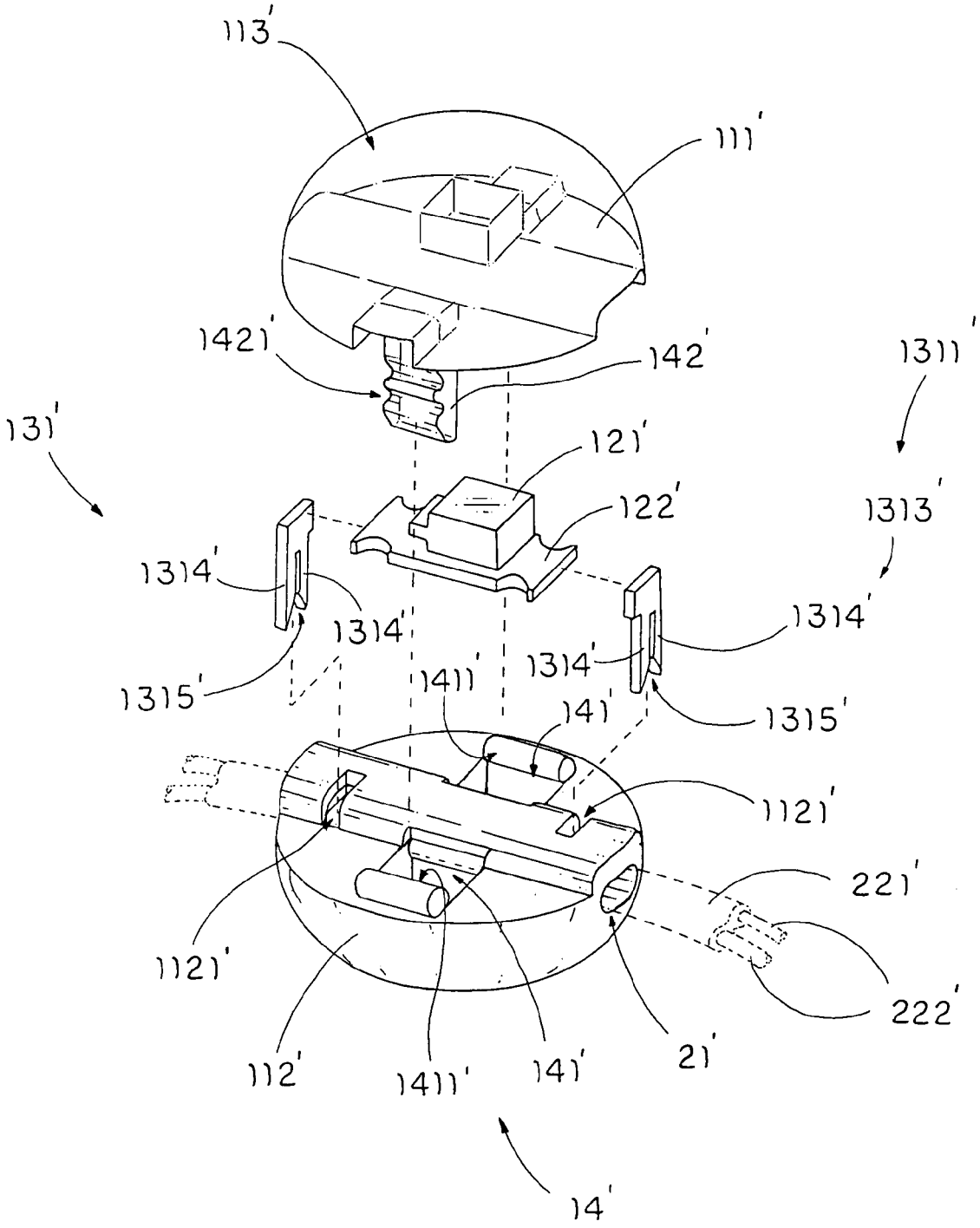
FIG. 7 is an exploded perspective view of an elementary building unit of the light-up accessory according to the above second preferred embodiment of the present invention.

Referring to FIGS. 6 to 7 of the drawings, each of the elementary building units 10' comprises a supporting case 11', a lighting system 12', and an operating system 13'. The supporting case 11' comprises an upper housing 111' and a lower base 112' wherein the lighting system 12' and the operating system 13' are disposed on the upper housing 111'. Moreover, the upper housing 111' has a light-transmissible surface 113' formed thereon wherein light generating from the lighting system 12' is capable of reaching outside of the elementary building units 10' though the light-transmissible surface 113'. According to the preferred embodiment, the light-transmissible surface 113' is achieved by utilizing plastic material having a predetermined transmissibility of light.

As shown in FIG. 7, each of the elementary building units 10' further comprises means 14' for securely mounting the upper housing 111' with the lower base 112'. The mounting means 14' has at least a holding slot 141', having a holding tooth 1411' transversely formed on the lower base 112' and comprises at least a fastening arm 142', having at least an engaging tooth 1421', slidably inserted into the holding slot 141' in such a manner that when the engaging tooth 1421' of the fastening arm 142' is engaged with the holding tooth 1411' of the holding slot 141', the upper housing 111' is securely mounted on the lower base 112'.

The lighting system 12' comprises at least an illuminating unit 121' disposed in the upper housing 111' for providing illumination, and a Printed Circuit Board (PCB) 122' electrically connected with the illuminating unit 121' for controlling illumination parameters, such as frequency and brightness, thereof. According to this preferred embodiment, the illuminating unit 121' is embodied as a Light Emitting Diode (LED) having predetermined illuminating features, such as the range of colors available, wherein the illuminating unit 121' is electrically built-in with the printed circuit board 122' for generating a light effect.

Each of the elementary building units 10' is adapted to be chained with two other elementary building units 10' so as to form a series for practical utilizations. Thus the chaining arrangement 20' contains a chaining passageway 21' longitudinally formed on each of the lower base 112' respectively wherein two ends of each of the chaining passageways 21' define two openings on the respective supporting case 10'. In other words, each of the upper housings 111' is capable of communicating with the respective chaining passageway 21'. The chaining arrangement 20' further comprises a connecting chain 22' adapted to pass through the elementary building units 10' via the chaining passageways 21' so as to chain up all the elementary building units 10'. The connecting chain 22' can simply be embodied as a thread or a string having a predetermined and sufficient strength for holding all the elementary building units 10'. However, according to the preferred embodiment, the connecting chain 22' is embodied as a two-wire cable comprising two insulating wire protective layers and two regular electrical wires embedded therein respectively.

According to the preferred embodiment, the connecting chain 22' comprises a tubular shelter 221' as the insulating wire protective layer and at least a terminal 222' which is embodied as the electrical wire received in the tubular shelter 221' and is extended therealong to electrically connect with a power supply 30'. Accordingly, the elementary building units 10' are adapted to be alignedly mounted along the connecting chain 22'. In other words, the connecting chain 22' is slidably extended through the chaining passageway 21' of each of the supporting cases 11 to slidably mount the supporting cases 11 along the connecting chain 22'.

Figure 8:
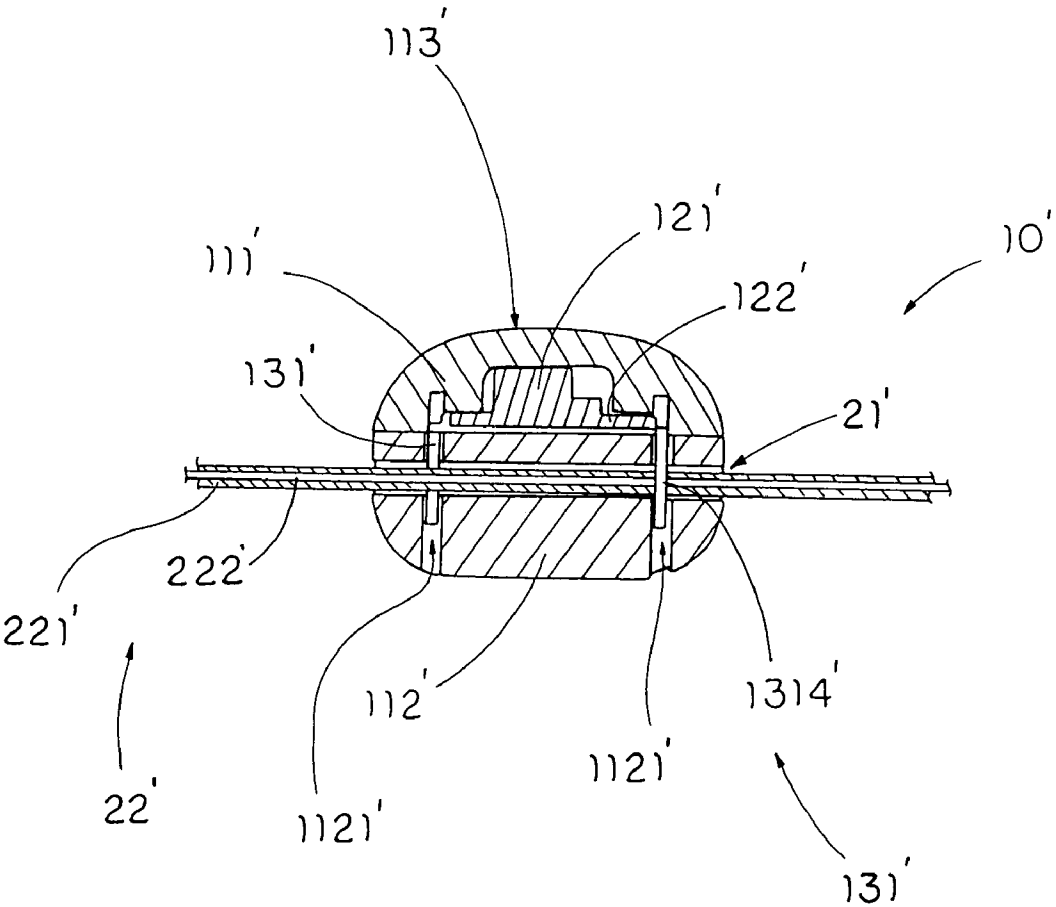
FIG. 8 is a sectional view of the elementary building unit of the light-up accessory according to the above second preferred embodiment of the present invention.

Referring to FIG. 8 of the drawings, the operating system 13' comprises an operating member 131' electrically connected with the printed circuit board 122' and operatively connected with an external power source so as to provide electricity to the printed circuit board 122' for powering up the illuminating unit 10'. The operating member 131' is embodied as comprising a pair of conducting members 1311' and a lighting switch 1312', wherein the lighting switch 1312' is arranged to switch the elementary building units 10' to connect with the power supply 30' as an electrical source upon switching on by a user of the present invention.

As shown in FIGS. 7 to 8, the upper housing 111' of each of the elementary building units 10' supports the lighting system 12' therewithin, wherein the chaining passageway 21' is longitudinally extended through the lower base 112' in such a manner that when the upper housing 111' is mounted on the lower base 112', the operating member 131' is extended into the chaining passageway 21' to penetrate through the tubular shelter 221' so as to electrically contact with the terminal 222'.

The two conducting members 1311' are embodied as two wire cutters 1313' respectively provided on two side portions of the upper housing 111' respectively, wherein each of the wire cutters 1313' comprises two elongated cutting members 1314' having an inwardly inclined cutter blade downwardly and spacedly extended towards two end portions of the chaining passageway 21' so as to define a receiving gap 1315' between the two cutting members 1314'. In addition, the lower base 112' further has two cutting slots 1121' formed thereon communicating the respective chaining passageway 21' and the upper housing 111' wherein the two wire cutters 1313' are arranged to be substantially aligned with the two cutting slots 1121' respectively.

In other words, each of the cutting slots 1121' is transversely formed on the lower base 112' to communicate with the chaining passageway 21' such that when the upper housing 111' is securely mounted on the lower base 112', the operating member 131' is guided to extend into the chaining passageway 21' through the cutting slot 1211'.

Therefore, by clamping the upper housing 111' and the lower base 112' towards each other, the conducting members 1311' is driven to move towards the corresponding chaining passageway 21' through the two cutting slots 1121' in such a manner that the operating member 131' is adapted to cut and shear the tubular shelter 221' so that the terminal 222' embedded therein is adapted to be tightly held in the respective receiving gap 1315' to make a direct contact with the conducting member 1311'. Thus, when the connecting chain 22' is applied with a potential difference by an external electricity source, the printed circuit board 122' will direct the electrical power to control the illumination of the illuminating units 121'.

As shown in FIG. 8, the conducing member 1311' is downwardly extended from the printed circuit board 122', wherein the two spaced apart cutting members 1314' define the receiving gap 1315' therebetween such that when the cutting members 1314' penetrate through the tubular shelter 221', the terminal 222' is positioned within the receiving gap 1315' to electrically contact with the conducting member 1311' for preventing the terminal 222' from being cut off by the operating member 131'.

Each of the cutting members 1314' has a tapered end such that an opening of the receiving gap 1315' formed between the two tapered ends of the cutting members 1314' is enlarged to receive the terminal 222' within the receiving gap 1315' through the opening thereof when the cutting members 1314' penetrate through the tubular shelter 221'.

Therefore, the upper housing 111' and the lower base 112' are clamped together in such a manner that the conducting members 1311' is driven to move towards the corresponding chaining passageway 21' through the two cutting slots 1121' to cut and shear part the insulating wire protective layer of the tubular shelter 221' so that the terminal 222', i.e. the electrical wires, embedded therein are adapted to be tightly held in the respective receiving gap 1315' to make a direct contact with the conducting member 1311'. By moving the upper hosing 111' and the lower base 112' away from each other, the user of the present invention is able to pull out or replace the connecting chain 21' for further connecting or reducing the number of elementary building units 10' utilized in the light-up accessory 1'.

Accordingly, the diameter of the terminal 222' should be substantially as same as or slight smaller than a width of the receiving gap 1315' so that the terminal 222' can be tightly received therein. In addition, the elementary building units 10' are electrically connected with the power supply 30' in a serial connection via the connecting chain 22'.

The power supply 30', according to the preferred embodiment, is a Direct Circuit (DC) battery hub having two electrical terminals which are adapted to connect with the two electrical terminals of the two-wire cable. The power supply 30' comprises a power hub 31' having a battery cavity 311' for receiving a replaceable battery as a power source therein to supply a DC power, wherein the lighting switch 1312' is provided on the power hub 31' and is operatively connected to the connecting chain 22' to selectively control the elementary building units 10' in an on and off manner, as shown in FIG. 6. It is worth to mention that DC current is used as the power source of the light-up accessory 1, there are two terminals 222' spacedly received within the tubular shelter 221', wherein two operating members 131' are spacedly extended from the printed circuit board 122' to electrically contact with the terminals 222' respectively through the cutting slots 1121' at the lower base 112', as shown in FIG. 7.

As shown in FIG. 6, the power supply 30' further comprises an electric connector 32' mounted at an end of the tubular shelter 221' to electrically connect with the terminal 222' and an electric adapter 33' provided at the power hub 31' for electrically connecting with the power source, wherein the electric connector 32' is detachably connected to the electric adapter 33' such that the connecting chain 22' is detachably connected with the power supply 30'.

Figure 5:
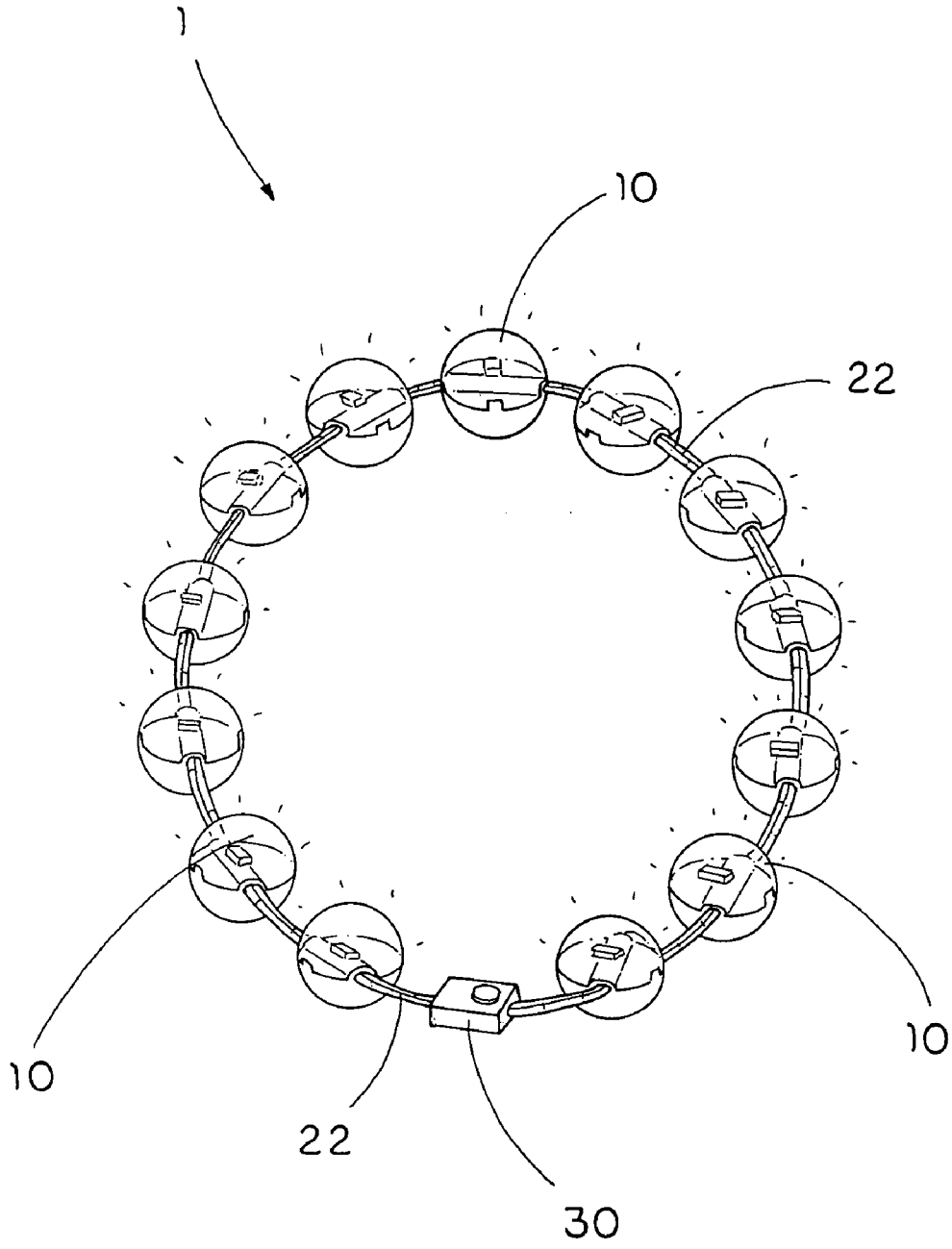
FIG. 5 is a perspective view of a light-up accessory according to the above preferred embodiment of the present invention.

The operation of the light-up accessory 1' of the present invention is demonstrated as follows: at the very beginning, a user of the present invention, such as a young girl, can deicide what she wants to assemble. For example, she may want to build up a necklace. Then she needs to decide how many elementary building units 10' are required. After that, she should be able to connect the required elementary building units 10' by inserting the connecting chain 22' into the chaining passageways 21' on the relevant elementary building units 10' and clamp the respective upper housing 111' and lower base 112' together to electrically contact the illuminating units 121' with the terminal 222' of the connecting chain 22' via the operating member 131'. Finally, the terminal 222' of the connecting chain 22' should be connected to the power supply 30' to form an endless light-up accessory 1'. At the same time, the power supply 30' will power up all the illuminating units 121' so that the light-up accessory of the present invention eventually become an 'illuminating necklace', as shown in FIG. 5.

Conversely, when the girl wants to expand or curtail the number of elementary building units 10', she may simply unclamp the upper housing 111' and the lower base 112' of each of the elementary building units 10' and then pull out or replace the connecting chain 22' with another one of appropriate length.

Thus, one can appreciate that the above-mentioned process can essentially be achieved solely by the hands of a young girl without risking to have any potential harm inflicted to her. The young girl can be able to select what he likes to build for a particular circumstance and utilize it not only as merely a toy, but also as an accessory of practical purposes. Note that, moreover, the shape of the elementary building units 10' can be varied for suiting various purposes. Thus, a set of elementary building units 10' can be supplied to users of the present invention so as to provide optimal satisfaction to her. It is worth mentioning that the supporting case 11' can be embodied as a variety of building elements of a variety of accessories, such as a bead for girl's necklace or bracelet, so as to fulfill differing requirements of the users of the present invention.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A light-up accessory, comprising:

a power supply;

a connecting chain comprising a tubular shelter and at least a terminal received in said tubular shelter and extended therealong to electrically connect with said power supply; and a plurality of elementary building units alignedly mounted along said connecting chain, wherein each of said elementary building units comprises:

a supporting case having an outer light-transmissible surface and a chaining passageway longitudinally extended through said supporting case such that said connecting chain is slidably extended through said chaining passageway to slidably mount said supporting case along said connecting chain, wherein each of said supporting cases comprises a lower base and an upper housing, wherein said chaining passageway is longitudinally extended through said lower base in such a manner that when said upper housing is mounted on said lower base;

a lighting system supporting within said supporting case and comprising an illuminating unit and a print circuit board electrically connected with said illuminating unit for controlling said illuminating unit to illuminate to outside through said light-transmissible surface of said supporting case; and an operating system comprising at least an operating member electrically extended from said printed circuit board, wherein said operating member is arranged to be extended into said chaining passageway to penetrate through said tubular shelter so as to electrically contact with said terminal so as to electrically connect said illuminating unit with said power supply and to substantially retain said supporting case along said connecting chain in position.

2. The light-up accessory, as recited in claim 1, wherein said lower base has at least a cutting slot transversely formed thereon to communicate with said chaining passageway such that when said upper housing is securely mounted on said lower base, said operating member is guided to extend into said chaining passageway through said cutting slot.

3. The light-up accessory, as recited in claim 2, wherein said operating member comprises a conducting member downwardly extended from said printed circuit board, wherein said conducting member has two spaced apart cutting members to define a receiving gap therebetween such that when said cutting members penetrate through said tubular shelter, said terminal is positioned within said receiving gap to electrically contact with said conducting member for preventing said terminal from being cut off by said operating member.

4. The light-up accessory, as recited in claim 3, wherein each of said cutting members has a tapered end such that an opening of said receiving gap formed between said two tapered ends of said cutting members is enlarged to receive said terminal within said receiving gap through said opening thereof when said cutting members penetrate through said tubular shelter.

5. The light-up accessory, as recited in claim 1, wherein each of said elementary building units further has at least a holding slot, having a holding tooth transversely formed on said lower base and comprises at least a fastening arm, having at least an engaging tooth, slidably inserted into said holding slot in such a manner that when said engaging tooth of said fastening arm is engaged with said holding tooth of said holding slot, said upper housing is securely mounted on said lower base.

6. The light-up accessory, as recited in claim 3, wherein each of said elementary building units further has at least a holding slot, having a holding tooth transversely formed on said lower base and comprises at least a fastening arm, having at least an engaging tooth, slidably inserted into said holding slot in such a manner that when said engaging tooth of said fastening arm is engaged with said holding tooth of said holding slot, said upper housing is securely mounted on said lower base.

7. The light-up accessory, as recited in claim 4, wherein each of said elementary building units further has at least a holding slot, having a holding tooth transversely formed on said lower base and comprises at least a fastening arm, having at least an engaging tooth, slidably inserted into said holding slot in such a manner that when said engaging tooth of said fastening arm is engaged with said holding tooth of said holding slot, said upper housing is securely mounted on said lower base.

8. The light-up accessory, as recited in claim 2, wherein said power supply comprises a power hub having a battery cavity for receiving a replaceable battery as a power source therein to supply a DC power and a lighting switch operatively connected to said connecting chain to selectively control said elementary building units in an on and off manner.

9. The light-up accessory, as recited in claim 7, wherein said power supply comprises a power hub having a battery cavity for receiving a replaceable battery as a power source therein to supply a DC power and a lighting switch operatively connected to said connecting chain to selectively control said elementary building units in an on and off manner.

10. The light-up accessory, as recited in claim 8, wherein said power supply further comprises an electric connector mounted at an end of said tubular shelter to electrically connect with said terminal and an electric adapter provided at said power hub for electrically connecting with said power source, wherein said electric connector is detachably connected to said electric adapter such that said connecting chain is detachably connected with said power supply.

11. The light-up accessory, as recited in claim 10, wherein said power supply further comprises an electric connector mounted at an end of said tubular shelter to electrically connect with said terminal and an electric adapter provided at said power hub for electrically connecting with said power source, wherein said electric connector is detachably connected to said electric adapter such that said connecting chain is detachably connected with said power supply.

12. The light-up accessory, as recited in claim 11, wherein said elementary building units are electrically connected with said power supply in a serial connection.

13. The light-up accessory, as recited in claim 12, wherein each of said illuminating units comprises a Light Emitting Diode, having a predetermined range of illuminating parameters, electrically built-in with said printed circuit board for generating a light effect.

14. A light-up accessory, comprising:

a power supply;

a connecting chain comprising a tubular shelter and at least a terminal received in said tubular shelter and extended therealong to electrically connect with said power supply; and a plurality of elementary building units alignedly mounted along said connecting chain, wherein each of said elementary building units comprises:

a supporting case having an outer light-transmissible surface and a chaining passageway longitudinally extended through said supporting case such that said connecting chain is slidably extended through said chaining passageway to slidably mount said supporting case along said connecting chain;

a lighting system, which is disposed in said supporting case, comprising an illuminating unit and a print circuit board electrically connected with said illuminating unit for controlling said illuminating unit to illuminate to outside through said light-transmissible surface of said supporting case; and an operating system comprising at least an operating member electrically extended from said printed circuit board, wherein said operating member is arranged to penetrate through said tubular shelter to electrically contact with said terminal so as to electrically connect said illuminating unit with said power supply and to substantially retain said supporting case along said connecting chain in position, wherein said operating member comprises a conducting member downwardly extended from said printed circuit board, wherein said conducting member has two spaced apart cutting members to define a receiving gap therebetween such that when said cutting members penetrate through said tubular shelter, said terminal is positioned within said receiving gap to electrically contact with said conducting member for preventing said terminal from being cut off by said operating member.

15. The light-up accessory, as recited in claim 14, wherein each of said cutting members has a tapered end such that an opening of said receiving gap formed between said two tapered ends of said cutting members is enlarged to receive said terminal within said receiving gap through said opening thereof when said cutting members penetrate through said tubular shelter.

16. A light-up accessory, comprising:

a power supply which comprises a power hub having a battery cavity for receiving a replaceable battery as a power source therein to supply a DC power and a lighting switch, wherein said power supply further comprises an electric connector and an electric adapter provided at said power hub for electrically connecting with said power source;

a connecting chain comprising a tubular shelter and at least a terminal received in said tubular shelter and extended therealong to electrically connect with said power supply, wherein said lighting switch is operatively connected to said lighting connecting chain to selectively control said elementary building units in an on and off manner, wherein said electric connector is mounted at an end of said tubular shelter to electrically connect with said terminal, wherein said electric connector is detachably connected to said electric adapter such that said connecting chain is detachably connected with said power supply; and a plurality of elementary building units alignedly mounted along said connecting chain, wherein each of said elementary building units comprises:

a supporting case having an outer light-transmissible surface and a chaining passageway longitudinally extended through said supporting case such that said connecting chain is slidably extended through said chaining passageway to slidably mount said supporting case along said connecting chain;

a lighting system, which is disposed in said supporting case, comprising an illuminating unit and a print circuit board electrically connected with said illuminating unit for controlling said illuminating unit to illuminate to outside through said light-transmissible surface of said supporting case; and an operating system comprising at least an operating member electrically extended from said printed circuit board, wherein said operating member is arranged to penetrate through said tubular shelter to electrically contact with said terminal so as to electrically connect said illuminating unit with said power supply and to substantially retain said supporting case along said connecting chain in position.

* * * * *